US007905645B2

(12) United States Patent
Batti et al.

(10) Patent No.: US 7,905,645 B2
(45) Date of Patent: Mar. 15, 2011

(54) ILLUMINATED FLOOR MAT

(76) Inventors: Stephen A. Batti, Hillsboro, OR (US); Stephen J. Brockman, Greenfield, IN (US)

( * ) Notice: Subject to any disclaimer, the term of this patent is extended or adjusted under 35 U.S.C. 154(b) by 159 days.

(21) Appl. No.: 12/147,699

(22) Filed: Jun. 27, 2008

(65) Prior Publication Data

US 2009/0126139 A1 May 21, 2009

Related U.S. Application Data

(60) Provisional application No. 60/988,241, filed on Nov. 15, 2007.

(51) Int. Cl.
*F21V 7/04* (2006.01)
*F21V 33/00* (2006.01)

(52) U.S. Cl. ..... 362/555; 362/551; 362/234

(58) Field of Classification Search ..... 362/487, 362/488, 551, 554, 555, 253, 234
See application file for complete search history.

(56) References Cited

U.S. PATENT DOCUMENTS

| | | | | |
|---|---|---|---|---|
| 4,542,906 | A * | 9/1985 | Takase et al. | 473/152 |
| 4,544,993 | A | 10/1985 | Kirk | |
| 4,737,764 | A | 4/1988 | Harrison | |
| 5,123,130 | A * | 6/1992 | Sanders | 4/661 |
| 5,343,375 | A | 8/1994 | Gross et al. | |
| 5,971,761 | A | 10/1999 | Tillman, Sr. | |
| 6,150,943 | A | 11/2000 | Lehman et al. | |
| 6,481,877 | B1 | 11/2002 | Bello, Jr. | |
| 6,709,137 | B1 | 3/2004 | Glovak et al. | |
| 6,896,388 | B2 | 5/2005 | George et al. | |
| 6,955,448 | B1 | 10/2005 | Lefferson | |
| 6,998,960 | B2 | 2/2006 | Buschmann et al. | |
| 7,242,313 | B2 | 7/2007 | Harwood | |
| 7,255,454 | B2 | 8/2007 | Peterson | |
| 2005/0243556 | A1 | 11/2005 | Lynch | |
| 2005/0276051 | A1 | 12/2005 | Caudle et al. | |
| 2008/0242437 | A1 * | 10/2008 | Taylor | 473/269 |

FOREIGN PATENT DOCUMENTS

JP 2001169861 A 6/2001

OTHER PUBLICATIONS

Web pages for Camping World, www.campingworld.com/shopping/item/wireless-under-cabinet..., printed Sep. 29, 2008, 3 pages.
Web pages for Step 'n Shine Wireless Night Lighting System, www.stepnshine.com, printed Aug. 18, 2008, 2 pages.
Web pages for The LED Light.com. www.theledlight.com/extreme.html, printed Sep. 30, 2008, 2 pages.

* cited by examiner

*Primary Examiner* — Thomas M Sember
(74) *Attorney, Agent, or Firm* — Woodard, Emhardt, Moriarty, McNett & Henry LLP

(57) ABSTRACT

An apparatus comprises a floor mat configured to illuminate at least partial outlines defining feet placement areas to assist a user in getting out of a bed in low light conditions. The floor mat includes left and right illumination paths at least partially outlining left and right foot placement areas, respectively, and at least one light source operable to provide illumination along the left and right illumination paths.

17 Claims, 6 Drawing Sheets

ILLUMINATED FLOOR MAT

CROSS-REFERENCE TO RELATED APPLICATIONS

This application claims the benefit of U.S. Provisional Application No. 60/988,241, filed Nov. 15, 2007, which is hereby incorporated by reference.

FIELD OF THE INVENTION

Embodiments of the present invention deal with the field of floor mats.

BACKGROUND OF THE INVENTION

For various consumers, there are concerns about getting out of bed in dark or low light conditions. Instability and falling due to improper foot placement when arising can be a serious concern. Furthermore, a light source may not be within easy reach, and/or, the person may desire not to turn on a bright light. For other consumers, it is desirable to have low level illumination at night for comfort. Accordingly, there is a need for a lighted mat usable next to a bed or in other situations to address these and other concerns.

SUMMARY OF THE INVENTION

In certain embodiments, an apparatus comprises a floor mat configured to illuminate at least partial outlines defining feet placement areas to assist a user in getting out of a bed in low light conditions. The floor mat includes left and right illumination paths at least partially outlining left and right foot placement areas, respectively, and at least one light source operable to provide illumination along the left and right illumination paths.

In certain embodiments, an illuminated floor mat positionable on a bedroom floor alongside a bed at a position where a user will normally step on the floor mat when leaving and returning to the bed comprises right and left fiber optic cables having first and second ends. The right and left cables are arranged in paths at least partially outlining right and left foot position areas, respectively. The floor mat includes at least one left LED and at least one right LED, the LED's being configured and positioned to illuminate the left and right fiber optic cables, respectively, from the first ends of the cables. The floor mat further includes an electrical unit coupled to the right and left LED's to control operation of the right and left LED's.

In certain embodiments, a method comprises providing a mold configured to create a floor mat piece via injection molding. The mold includes left and right ridges configured to create corresponding left and right channels in the floor mat piece. The channels at least partially outline left and right foot placement areas on the floor mat piece. The method includes injecting a flowable plastic material into the mold and allowing the flowable plastic material to set in place to create the floor mat piece having the left and right channels. The method further includes inserting left and right fiber optic cables into the left and right channels, respectively, and coupling at least one LED to an open end of each of the fiber optic cables to provide light along the cables to illuminate the outlines of the foot placement areas to assist a user in low light conditions.

DESCRIPTION OF THE ILLUSTRATED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Certain embodiments of the present invention provide illuminated floor mats preferably usable in dark or low light conditions. As one example, an illuminated floor mat according to the invention can be placed next to a bed for a person to use when arising. In certain situations the illuminated floor mat assists the person by allowing improved depth perception, spatial orientation and by potentially illuminating hazards on the floor and/or near the bed. Illuminated floor mats allow the person to avoid finding or reaching for a brighter light source and/or may allow the person to avoid turning on a bright light that could potentially disturb them or another person in the room.

In certain preferred embodiments, the floor mats include a cushioned rubber or plastic surface with an embedded electronic unit. The electronic unit incorporates light sources such as LED's which illuminate shapes defined in the mat. Example shapes are partial or complete footprint outlines to define foot placement. Alternate examples could include holiday or special occasion patterns.

Figure 2:
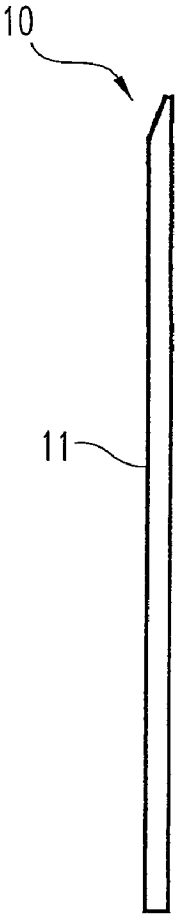
FIG. 2 is a side view of the embodiment of FIG. 1.
Figure 1:
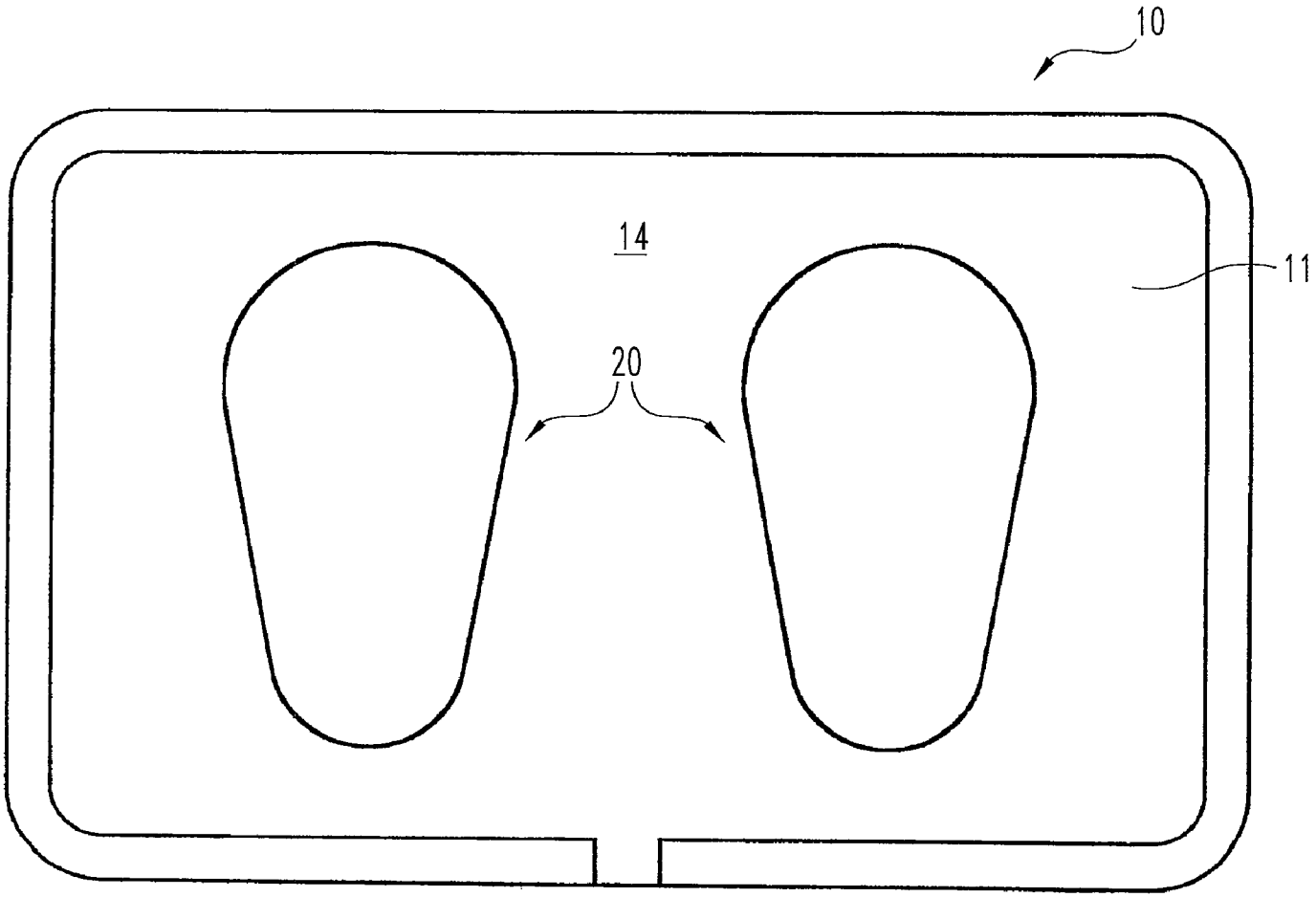
FIG. 1 is a top view of a lighted mat according to one preferred embodiment of the present invention.

FIGS. 1 and 2 illustrate external views of an example floor mat 10 according to a preferred embodiment of the present invention. Floor mat 10 typically is arranged to lie on a support surface with an exposed upper surface or top 11. The primary material for mat 10 is a rubber or plastic preferably with cushioning and resilient properties to provide comfort when stepped upon by a person. The majority of the mat surface 14 is blank, with the exception of defined shapes 20 seen by the user on or in the mat. Defined shapes 20 in the mat can be various geometric or custom shapes as preferred, with one example being a full or partial foot outline to define foot placement for someone stepping onto the mat. Various alternate shapes can be used to define placement, to define patterns for decoration or to provide additional information.

As non-limiting examples, the foot width averages for placement of shapes 20 can range between 3.6 inches and 4.3 inches with a median or $50^{th}$ percentile at 3.9 inches for males while females are typically 0.5 inches less. The foot length averages can range between 9.7 inches to 10.9 inches with the $50^{th}$ percentile being at 10.2 inches for males while females are typically 1 inch less. Preferably, the outside of the foot position matches the outside of the person's shoulder with example shoulder width averages ranging from 15.6 inches to 18.5 inches for males with a $50^{th}$ percentile at 17 inches. Females typically have 2 inches less in shoulder width averages.

Figure 3:
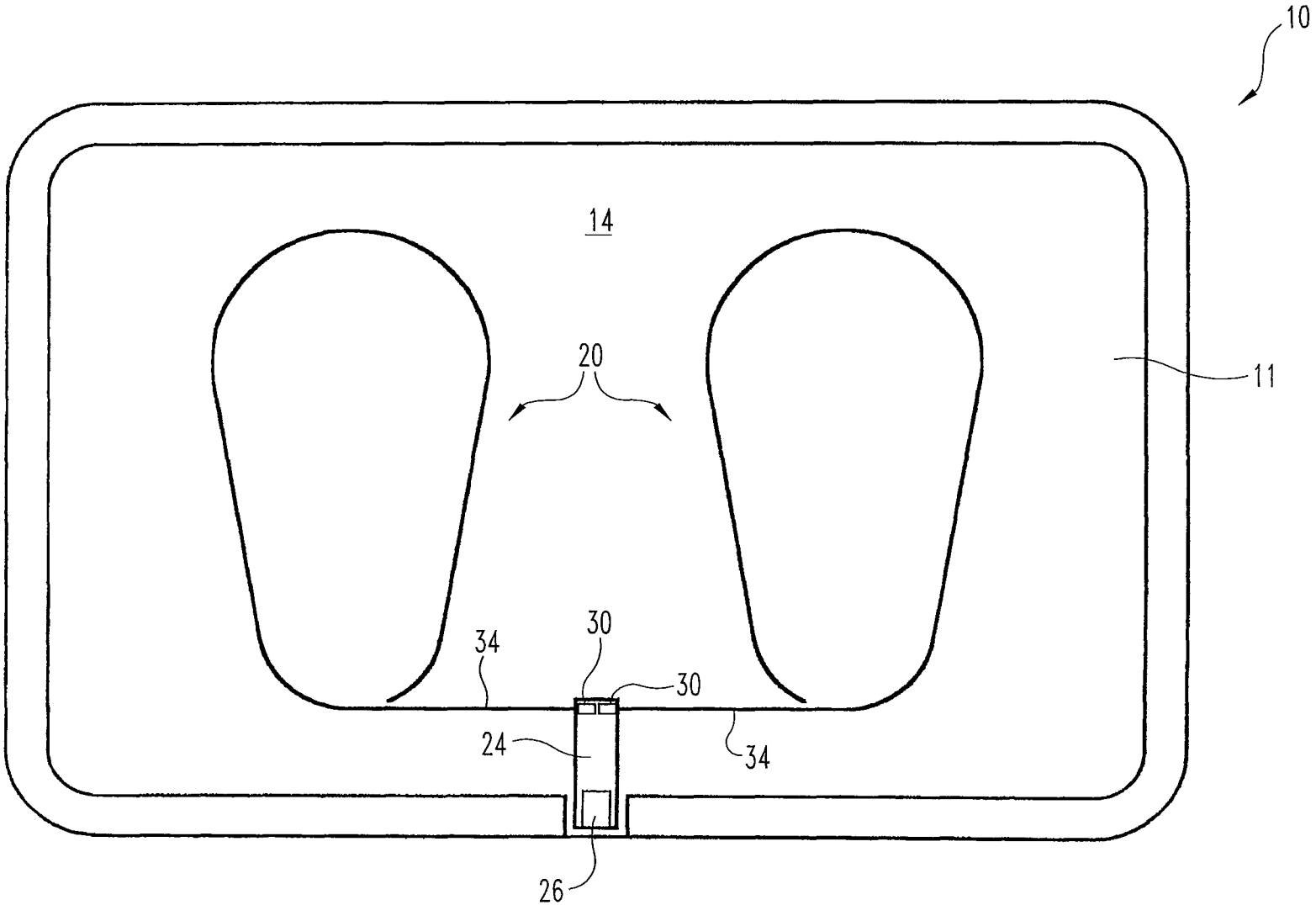
FIG. 3 is a top view of the mat of FIG. 1 with internal elements illustrated.

A schematic of electronics for mat 10 is illustrated in FIG. 3. In the embodiment illustrated, mat 10 includes an electronic unit 24 adjacent one edge of the mat. Electronic unit 24 includes a power connector 26 to which a power cord can be coupled in an either permanent or pluggable and unpluggable arrangement. Electronic unit 24 preferably further includes light sources 30 such as two LED's which provide illumination for the mat. Extending from electronic unit 24 are fiber optic cables 34. The fiber optic cables preferably each have one end aligned to receive light from a light source 30 and the fiber optic cables are arranged in the mat to extend to and define the desired patterns in the mat, such as shapes 20.

Fiber optic cables 34 receive illumination from light sources 30 and transmit it along the length of the cable to be emitted upwards from the top 11 of the mat. The fiber optic cables 34 can be masked along all or portions of their length and their non LED end so that transmitted light is emitted laterally only in desired locations. This arrangement can allow for the cable to only emit light in desired areas, which can be either a continuous or multiple point emission. In one example, fiber optic cables extend from the light sources around the outer perimeter of shapes 20 in a generally foot shaped arrangement. In an alternate arrangement, a fiber optic cable extends only part way around the inner or outer edge of the foot to define locations for desired foot placement either outside of inner lines or inside of outer lines for the feet.

In various embodiments, different colored LED's can be used as light sources 30 with certain preferred examples including green, blue, and red. Optionally, a plurality of light sources can be used in the same or different colors to illuminate corresponding fiber optic cables defining pre-selected shapes or patterns. The power supply preferably provides power appropriate for LED illumination in the electronic unit, and may for example include a step down transformer connectable to household current. In an optional arrangement, the power supply or electronic unit may incorporate batteries to continue to illuminate the shapes on the mat during a power interruption.

In a still further option, electronic unit 24 may include circuitry or a mechanical filter such as a color wheel to vary the color of the light emitted from the mat in a regular or random sequence. Color changing circuitry may be used, for example, when the mat provides low level illumination in a night light situation for a child or adult. The projected light from the mat can, for example, be projected on the ceiling, to provide entertainment and or a calming effect for a child or adult in the bed.

In one method of manufacture, the electronic unit and fiber optic cables can be insertion molded within mat 10. The electronic unit and fiber optic cables are arranged in desired locations in a mold, after which the mat material is poured or injected in a liquid form. The mat material is preferably allowed to then set in place with the electronic unit and fiber optic cables embedded in the mat thickness at pre-selected heights. The electronic unit is preferably cushioned and protected from direct contact from above or below. The fiber optic cables may be embedded in the middle thickness of the mat or alternately allowed to lie flush with the top or slightly protruding from the mat top 11. The mat material may optionally be clear in color to allow ease of viewing the embedded fiber optic cables, or alternately can be a solid color or patterned as desired so long as the ability to view shapes 20 is maintained in low light conditions. In one example, the mat can have dimensions of 20 inches by 16 inches in length and width with a thickness between $3/8^{th}$ to 1½ inches.

Figure 4:
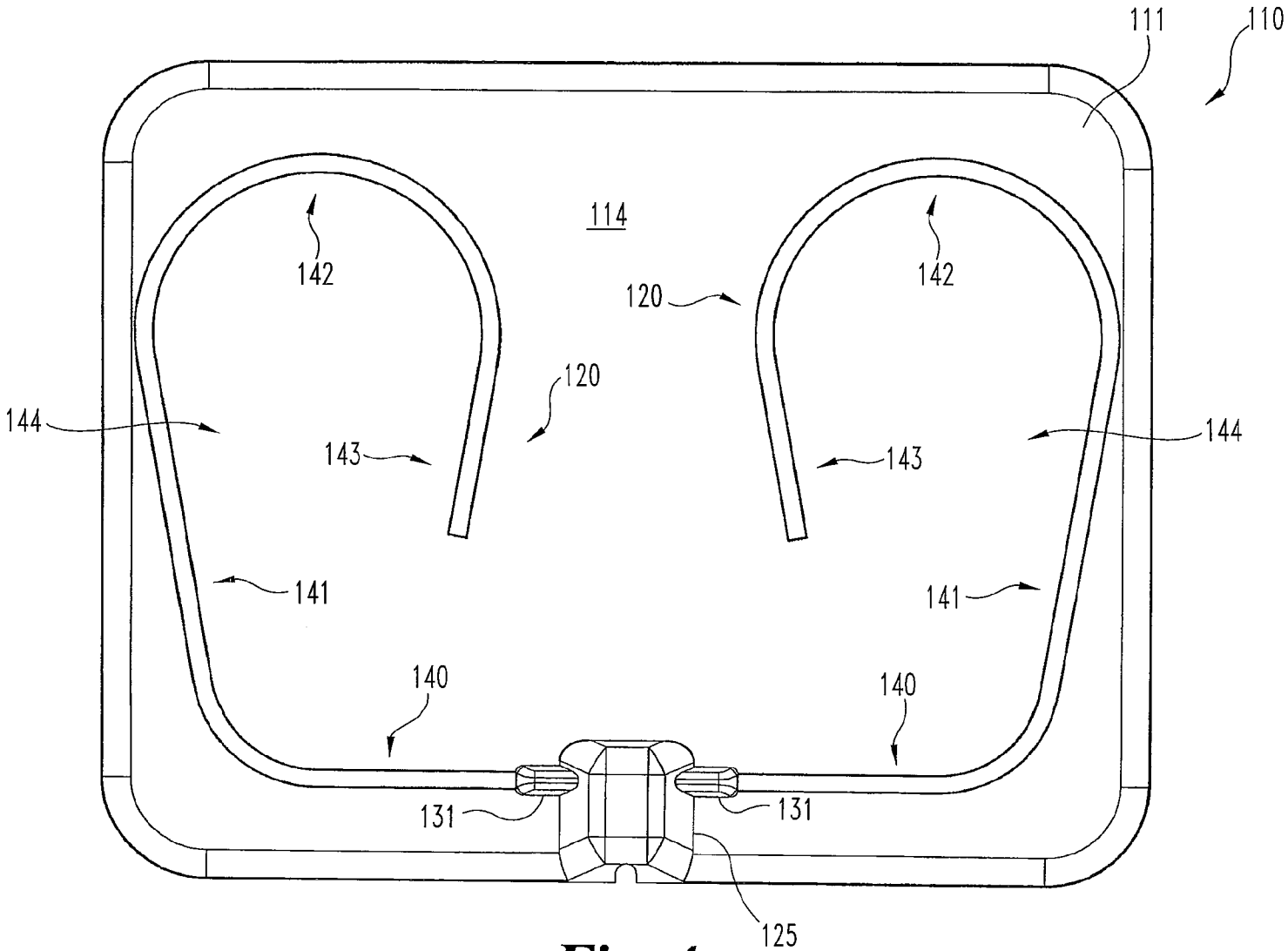
FIG. 4 is a top view of a lighted mat according to another preferred embodiment of the present invention.
Figure 5:
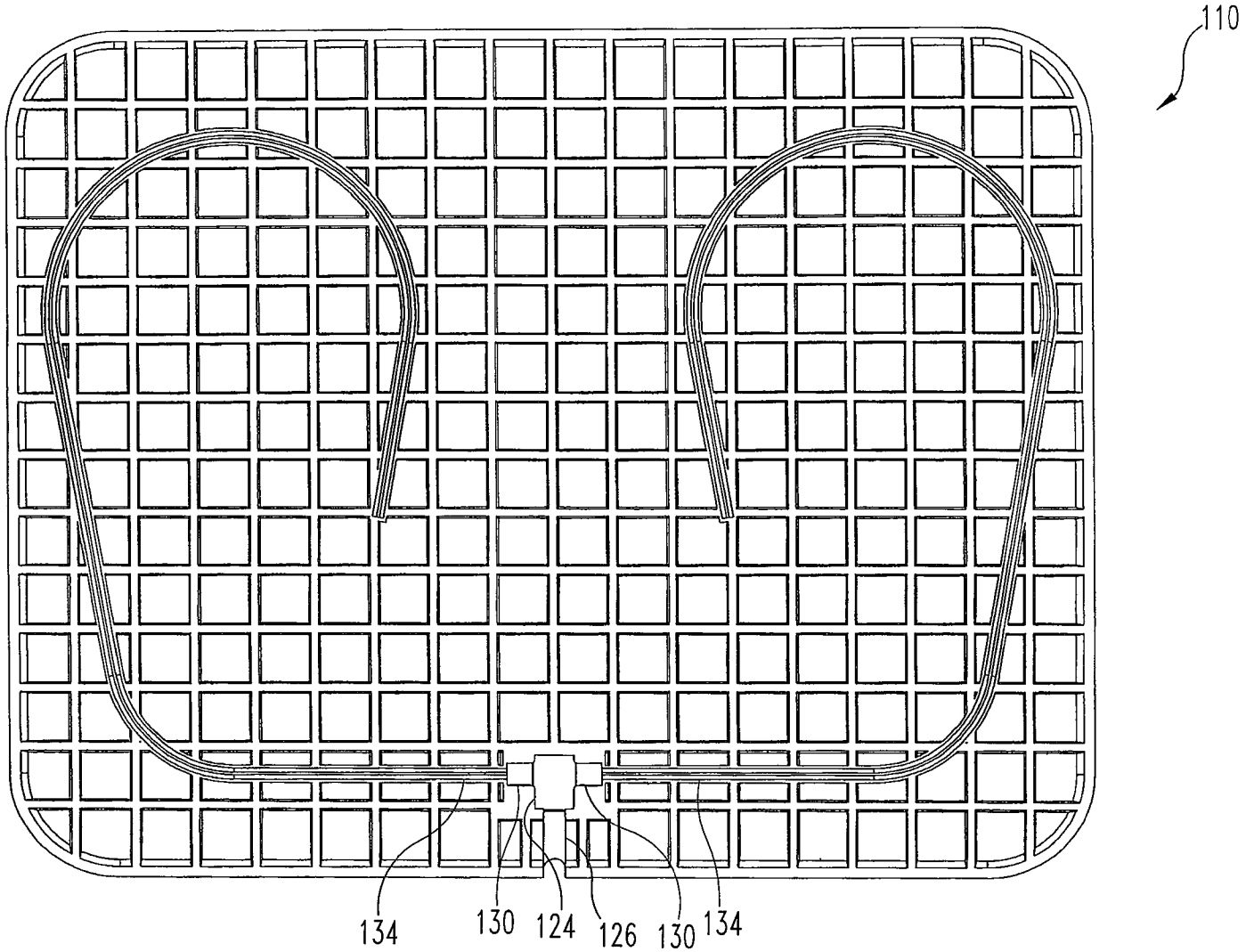
FIG. 5 is a bottom view of the mat of FIG. 4 with internal elements illustrated.
Figure 6:
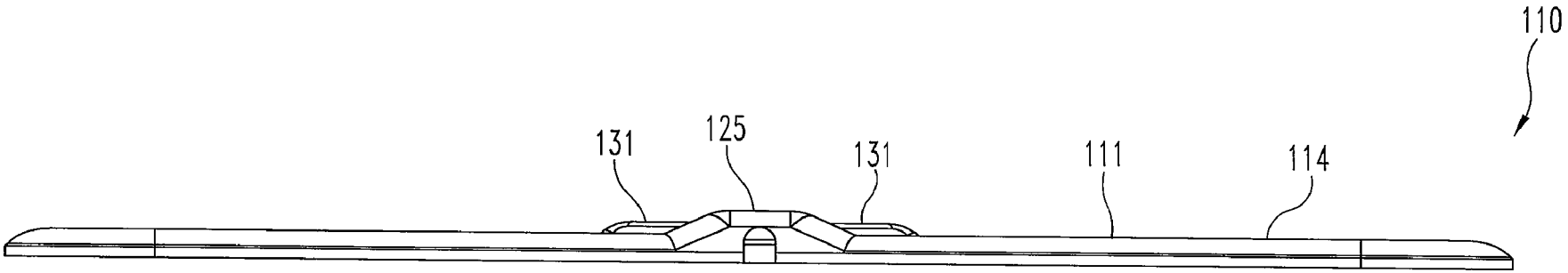
FIG. 6 is a front view of the embodiment of FIG. 4.

FIGS. 4-6 illustrate views of another example floor mat 110 according to another embodiment of the present invention. Floor mat 110 typically is arranged to lie on a support surface with an exposed upper surface or top 111. The primary material for mat 110 may be a rubber or plastic preferably with cushioning and resilient properties to provide comfort when stepped upon by a person. The majority of the mat surface 114 is blank, with the exception of defined shapes 120 seen by the user on or in the mat. Defined shapes 120 in the mat can be various geometric or custom shapes as desired, with one example being a full or partial foot outline to define foot placement for someone stepping onto the mat. In the illustrated example, each defined shape 120 has various segments including a straight segment 140 leading from light sources, angled segments 141 and 143, and a half-circular segment 142 extending between the angled segments. As illustrated, angled segment 143 may not fully extend back to straight segment 140. Segments 140-143 collectively and generally create a foot shaped outline pattern, and collectively and generally define a foot placement area 144 for a person to place their foot.

It should be appreciated that in certain embodiments the segments defining the foot placement area are mirror images of each other. Additionally, in certain embodiments, the defined foot placement areas may be specifically sized and configured to correspond to foot width and length averages for males and/or females, and may be spaced apart a distance which corresponds to shoulder width averages for males and/or females. Various alternate shapes can be used to define placement, to define patterns for decoration or to provide additional information. As an example alternate arrangement, the defined shapes could include segments extending only part way around the inner or outer edge of the foot placement area to define locations for desired foot placement either outside of inner lines or inside of outer lines for the feet.

A schematic of example electronics for mat 110 underneath top surface 111 is illustrated in FIG. 5. In the embodiment illustrated, mat 110 includes an electronic unit 124 adjacent one edge of the mat. Electronic unit 124 includes a power connector 126 to which a power cord can be coupled in an either permanent or pluggable and unpluggable arrangement. In other embodiments, electronic unit 124 includes one or more batteries to provide power to the floor mat. Electronic unit 124 is preferably coupled to light sources 130 such as LED's which provide illumination for the mat. Extending from light sources 130 are fiber optic cables 134. As illustrated, the fiber optic cables preferably each have one end aligned to receive light from a light source 130 and the fiber optic cables are arranged in the mat to extend to and define the desired patterns in the mat, such as shapes 120.

In certain embodiments, mat 110 may include an electronic unit cover 125 and light source covers 131 (see FIG. 4) to protect the electronic unit and the light sources disposed within the mat from direct contact or crushing. In some embodiments, covers 125 and 131 extend up from mat surface 114 (see FIG. 6). In other embodiments, covers 125 and 131 may be below or substantially level with mat surface 114. In yet other embodiments, covers 125 and 131 may be absent.

Fiber optic cables 134 receive illumination from light sources 130 and transmit it along the length of the cable to be emitted upwards toward and through top 111 of the mat. The fiber optic cables 134 can be masked along all or portions of their length and their non LED end so that transmitted light is emitted laterally only in desired locations. This arrangement can allow for the cable to only emit light in desired areas, which can be either a continuous or multiple point emission. In one example, fiber optic cables extend from the light sources around the outer perimeter of shapes 120 in a generally foot shaped arrangement, as described above.

In various embodiments, different colored LED's can be used as light sources 130 with certain preferred examples including green, blue, and red. Optionally, a plurality of light sources can be used in the same or different colors to illuminate corresponding fiber optic cables defining pre-selected shapes or patterns. The power supply preferably provides power appropriate for LED illumination in the electronic unit, and may for example include a step down transformer connectable to household current. In an optional arrangement, the power supply or electronic unit may incorporate batteries to continue to illuminate the shapes on the mat during a power interruption.

In a still further option, electronic unit 124 may include circuitry or a mechanical filter such as a color wheel to vary the color of the light emitted from the mat in a regular or random sequence. Color changing circuitry may be used, for example, when the mat provides low level illumination in a night light situation for a child or adult. The projected light from the mat can, for example, be projected on the ceiling, to provide entertainment and or a calming effect for a child or adult in the bed.

In one method of manufacture, channels corresponding to the sizes and configurations of the fiber optic cables can be formed within the mat material such that the channels are configured to receive the cables from the top or bottom. In some embodiments, the mat is formed via a molding process, such as injection molding, with the mold component(s) having one or more ridges or protrusions configured to form the channels. The mold component(s) are arranged as desired, after which the mat material is poured or injected in a liquid form into the mold and allowed to set in place. After the mat material sets in place, the fiber optic cables can be inserted into the formed channels. The fiber optic cables may be embedded in the middle thickness of the mat or alternately allowed to lie flush with the top or slightly protruding from the mat top 111.

The light sources and the electrical unit are operatively coupled to the fiber optic cables, with the optional covers placed over the electrical unit and the light sources, to form the mat. In certain embodiments, cavities corresponding to the sizes and configurations of the electrical unit and the light sources, and thus configured to receive such components, may optionally be formed within the mat material via the injection molding process. In such cases, the electrically unit and light sources may be at least partially embedded in the mat material.

The mat material may optionally be clear in color to allow ease of viewing the fiber optic cables, or alternately can be a solid color or patterned as desired so long as the ability to view shapes 120 is maintained in low light conditions. In one example, the mat can have overall dimensions of 20 inches by 16 inches in length and width with a thickness between $3/8^{th}$ to 1½ inches.

The illuminated floor mats contemplated by the present disclosure may be operated and/or controlled in a variety of different ways. In some embodiments, the mats may be controlled locally via control mechanisms integrated into the units themselves. In such cases, the mats typically include on/off power switches or buttons. Optionally, the mats may include additional buttons controlling various other aspects of the mats, such as lighting color, lighting intensity, duration of the lighting, timed control of the mat lighting, and/or other features as would generally occur to one skilled in the art. In some embodiments, the floor mats may be configured so that the activation and deactivation of the illumination of the floor mats occurs in response to an individual stepping on the mat. In other embodiments, the mats may be controlled remotely either in addition to or in lieu of local control, as will be discussed in greater detail below.

Figure 7:
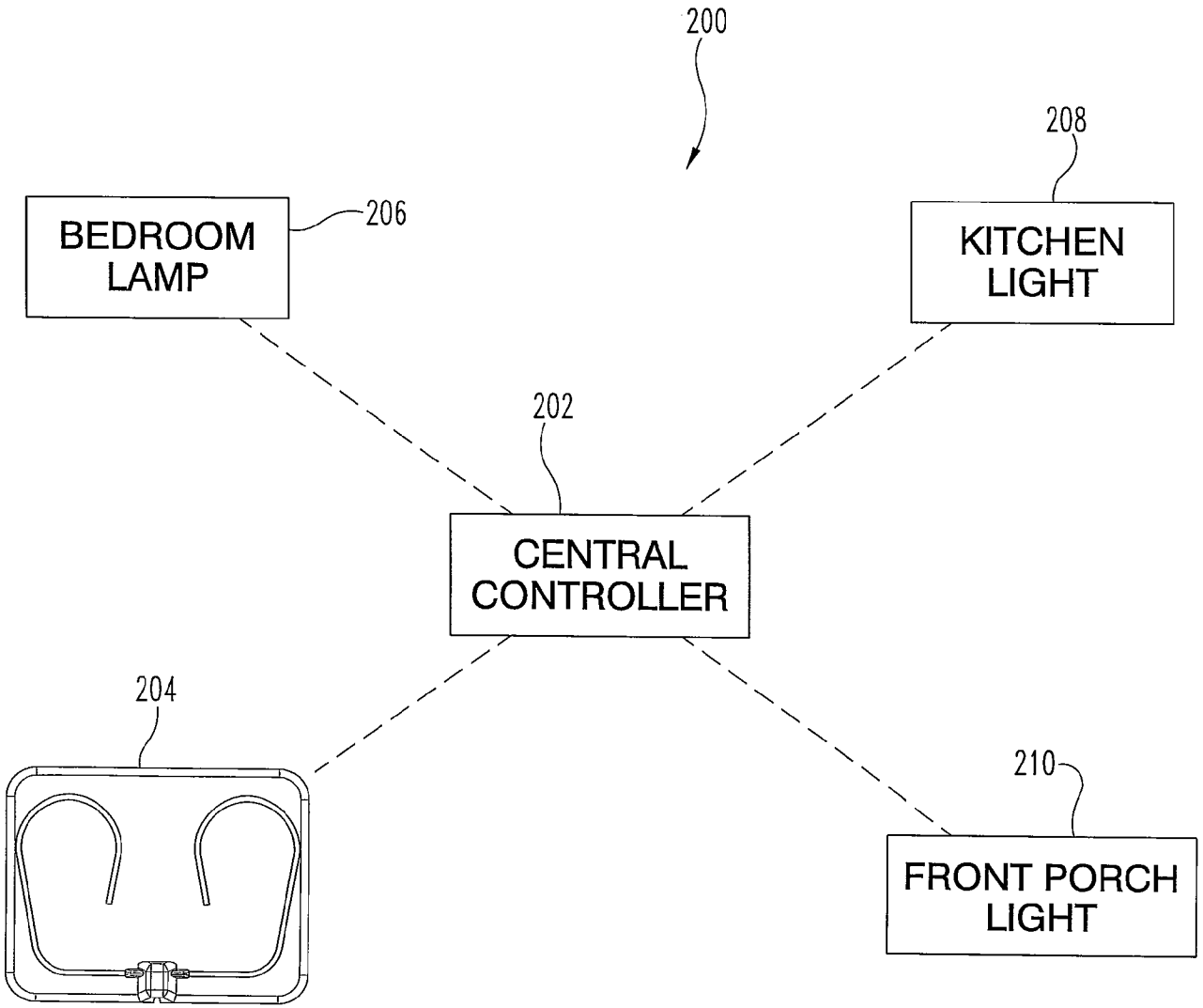
FIG. 7 is a schematic of a control system according to another embodiment of the present invention.

As an example embodiment of remote control, FIG. 7 illustrates a central control system 200 for controlling the illumination of a floor mat according to the present disclosure, and optionally other household items as well. In the illustrated embodiment, system 200 includes a central control processor or controller 202 operable to control an illuminated floor mat 204 and other typical household items including for example a bedroom lamp 206, a kitchen light 208 and a front porch light 210. Illuminated floor mat 204 is a floor mat contemplated by the present disclosure, such as floor mats 10 and 110. It is contemplated that controller 202 could control various different types of household items as would generally occur to one skilled in the art. In certain embodiments, controller 202 controls typical light-producing household items such as lamps and overhead lights. In other embodiments, controller 202 may also control household appliances.

In the illustrated embodiment, central controller 202 is wireless and operable to produce radio frequency (RF) signals and each item controlled by controller 202 includes an RF receiver operable to receive and process the RF signals. The RF signals sent by controller 202 direct the activation and deactivation of the items 204, 206, 208 and/or 210. In alternative embodiments, in lieu of wireless signals, the controller may be hardwired to the items to be controlled. Controller 202 may be programmed by a user as a timer to set or program the desired length and timing of activation of the controlled items. In other embodiments, the controlled items remain activated until the user directs controller 202 to deactivate some or all of the items.

In some embodiments, controller 202 has uniform control over all the items and activates the items simultaneously. In other embodiments, controller 202 may provide selective control over the items, with the activation of each item being separately programmable. In certain embodiments, one or more of the items controlled by controller 202 include manual override mechanisms to allow a user to activate or deactivate the item manually as desired, and to locally override the control from controller 202. It is contemplated that the central controller may be a computer, or may be operatively linked to a computer, so that a user of the system can control the illuminated mat and other optional items through the computer. Additionally, the controller, or a computer coupled with the controller, may be linked to the internet so that a user may activate and deactivate the items as desired over the internet from a remote location outside of the house. In certain embodiments, there may be multiple controllers at multiple locations around the house so that a user can control the items from various locations.

It is also contemplated that in some embodiments, an illuminated mat according to the present disclosure may be controlled via a handheld or locally mounted wireless remote control, with the illuminated mat including an internal receiver operable to communicate with the remote control. In some embodiments, the remote control may be dedicated to the illuminated floor mat. In other embodiments, the remote control may be designed to control the operation of a plurality of household items in addition to the illuminated floor mat. In alternative embodiments, the remote control may be wired to the illuminated floor mat for control of the floor mat.

In further embodiments, activation of the illuminated floor mats according to the present disclosure may be triggered by one or more events. The illuminated floor mats could be designed and configured to activate lighting within the mat upon the occurrence of one or more numerous possible events, examples including movement, sound, pressure, darkness, and/or a fire, security or wake-up alarm. In certain embodiments, the floor mats may be designed to illuminate only upon the occurrence of the particular event(s), or the triggered activation may occur in addition to other activation and/or control methods described herein or as would generally occur to one skilled in the art. To give an example configuration of triggered activation, the floor mats may be designed to illuminate upon the sounding of a fire alarm to assist the user in getting out of bed safely to exit the residence. In other embodiments, particular events may trigger the change of intensity or color of the illumination of the floor mats.

In certain embodiments, the illuminated floor mats may also be activated via radio frequency identification (RFID). In such methods, RFID tags may be used to activate illumination of the floor mats. As those skilled in the art recognize, the RFID tags may be passive (no internal power supply) or active (contains an internal power supply). The RFID tags typically receive and transmit signals from a transmitter producing radio frequency signals to locate the RFID tags. In such cases, the floor mats may include transmitter devices which are operable to send RF signals and activate the floor mat in response to an RFID tag or similar device coming within a certain proximity of the transmitter device. As an example, a user may wear or carry on their person an active or passive RFID tag or similar device. The transmitter devices within the floor mats may be designed so that when the RFID item is within a specific distance of the receiver, such as 10 feet as an example, the transmitter device will direct illumination of the floor mat to assist the user. As an example, the RFID item may be a medallion that the user can wear around their neck at nighttime.

In some embodiments, local activation and deactivation of the illumination of the mat may be operable to correspondingly activate and deactivate one or more other electronic items. In such embodiments, the mat may be operatively coupled, wirelessly or otherwise, to another light in the house such that illumination of the mat may substantially simultaneously cause or direct or activate the illumination of the other lighting item. As an example, illumination of the mat resulting from an individual stepping on the mat may trigger illumination of a hallway light to assist the individual in moving around the area. As another example, illumination of the mat may trigger activation of another electronic device such as a radio.

Additionally, in certain embodiments, the illumination of the floor mat may include stepped intensity. As such, the floor mat may be illuminated in at least two different intensities: a low-light mode and a higher-light mode. The mat may be controlled so that the at least two different modes or intensities are activated based on certain conditions. For example, the mat may continuously be at a low-light mode or intensity during the nighttime hours so that the mat is at least slightly visible to an individual getting out of bed or a chair, with the illumination of the mat changing to a higher-light mode or intensity when the individual steps on the mat. The higher-light mode can remain in effect for either a predetermine time or until a predetermine event or action occurs.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus, comprising:

a floor mat configured to illuminate at least partial outlines defining feet placement areas to assist a user in getting out of a bed in low light conditions, wherein the floor mat includes:

left and right illumination paths at least partially outlining left and right foot placement areas, respectively, wherein said left and right illumination paths each include at least one fiber optic cable positioned to outline the corresponding foot placement area; and at least one light source operable to provide illumination along said left and right illumination paths, wherein said at least one light source includes at least one right LED configured and positioned to provide light along said at least one fiber optic cable corresponding to said right illumination path and at least one left LED configured and positioned to provide light along said at least one fiber optic cable corresponding to said left illumination path.

2. The apparatus of claim 1, further comprising an electrical unit coupled to said at least one light source to control illumination thereof.

3. The apparatus of claim 2, further comprising a power connector operatively coupled to said electrical unit, wherein said power connector is configured to couple with a power cord.

4. The apparatus of claim 2, wherein said electrical unit includes color changing circuitry operable to direct the change of color of light emitted from said at least one light source.

5. The apparatus of claim 1, wherein said fiber optic cables are partially masked to direct illumination from said cables.

6. The apparatus of claim 1, wherein illumination of said floor mat is controllable by a central household controller.

7. The apparatus of claim 6, wherein said central household controller also controls the illumination of at least one other household item.

8. The apparatus of claim 6, wherein illumination of said floor mat is controllable by a timer component of said central household controller.

9. The apparatus of claim 1, further comprising a handheld remote control operatively and wirelessly coupled with said floor mat, wherein illumination of said floor mat is controllable by a user via said handheld remote control.

10. An illuminated floor mat positionable on a bedroom floor alongside a bed at a position where a user will normally step on the floor mat when leaving and returning to the bed, comprising:

a right fiber optic cable having a first end and a second end and arranged in a path at least partially outlining a right foot position area;

a left fiber optic cable having a first end and a second end and arranged in a path at least partially outlining a left foot position area;

at least one right LED configured and positioned to illuminate said right fiber optic cable from said first end of said right fiber optic cable;

at least one left LED configured and positioned to illuminate said left fiber optic cable from said first end of said left fiber optic cable; and an electrical unit coupled to said right and left LED's to control operation of said right and left LED's.

11. The apparatus of claim 10, wherein said fiber optic cables are partially masked to direct illumination from said cables.

12. The apparatus of claim 10, wherein illumination of said floor mat is controllable by a central household lighting controller.

13. The apparatus of claim 10, wherein said electrical unit includes color changing circuitry operable to direct the change of color of light emitted from said left and right LED's.

14. The apparatus of claim 10, further comprising a handheld remote control operatively and wirelessly coupled with said floor mat, wherein illumination of said floor mat is controllable by a user via said handheld remote control.

15. A method, comprising:

providing a mold configured to create a floor mat piece via injection molding, wherein the mold includes left and right ridges configured to create corresponding left and right channels in the floor mat piece, wherein the channels at least partially outline left and right foot placement areas on the floor mat piece;

injecting a flowable plastic material into the mold;

allowing the flowable plastic material to set in place to create the floor mat piece having the left and right channels;

inserting left and right fiber optic cables into the left and right channels, respectively; and, coupling at least one LED to an open end of each of the fiber optic cables to provide light along the cables to illuminate the outlines of the foot placement areas to assist a user in low light conditions.

16. The method of claim 10, further comprising coupling an electrical unit to the at least one LED to control operation of the LED.

17. The method of claim 10, further comprising positioning at least one cap over the at least one LED.

* * * * *